US006663517B2

(12) United States Patent
Buiatti et al.

(10) Patent No.: US 6,663,517 B2
(45) Date of Patent: Dec. 16, 2003

(54) RIGID SHELL LAYERED SOFTBALL BAT WITH ELASTOMER LAYER

(75) Inventors: John Buiatti, Castaic, CA (US); Dewey Chauvin, Simi Valley, CA (US); Gary W. Filice, Moorpark, CA (US)

(73) Assignee: Jas. D. Easton, Inc., Van Nuys, CA (US)

( * ) Notice: Subject to any disclaimer, the term of this patent is extended or adjusted under 35 U.S.C. 154(b) by 0 days.

(21) Appl. No.: 10/167,094

(22) Filed: Jun. 10, 2002

(65) Prior Publication Data

US 2002/0151392 A1 Oct. 17, 2002

Related U.S. Application Data

(63) Continuation of application No. 09/585,233, filed on May 31, 2000, now abandoned.

(51) Int. Cl.[7] ..... A63B 59/06
(52) U.S. Cl. ..... 473/566
(58) Field of Search ..... 473/519, 520, 473/564–568

(56) References Cited

U.S. PATENT DOCUMENTS

| | | | | | |
|---|---|---|---|---|---|
| 5,511,777 | A | * | 4/1996 | McNeely | 473/520 |
| 5,624,115 | A | * | 4/1997 | Baum | 473/567 |
| 6,042,493 | A | * | 3/2000 | Chauvin et al. | 473/566 |
| 6,398,675 | B1 | * | 6/2002 | Eggiman et al. | 473/566 |
| 6,432,007 | B1 | * | 8/2002 | Filice et al. | 473/566 |

FOREIGN PATENT DOCUMENTS

| | | | |
|---|---|---|---|
| JP | 51-13165 | * | 4/1976 |

* cited by examiner

*Primary Examiner*—Mark S. Graham
(74) *Attorney, Agent, or Firm*—Perkins Coie LLP

(57) ABSTRACT

A thin wall tubular bat, particularly for softball, has a constant barrel diameter and an internal tubular insert spaced from the barrel with a shear stress transmitting elastomeric layer sandwiched between the barrel and insert so that the insert reinforces the barrel to reduce denting which would otherwise occur as the elastomer efficiently transfers stress to the insert and stores and releases energy during impact of the bat with a ball.

20 Claims, 3 Drawing Sheets

RIGID SHELL LAYERED SOFTBALL BAT WITH ELASTOMER LAYER

This application is a continuation of U.S. patent application Ser. No. 09/585,233, filed May 31, 2000 abandoned, which is herein incorporated by reference.

BACKGROUND OF THE INVENTION AND PRIOR ART

1. Field of the Invention

The present invention relates to hollow bats primarily for softball, and more particularly, to metallic and composite hard shell bats. Such bats typically include a metal outer shell which may be formed of aluminum or titanium alloy or other metals or of composite construction. As referred to herein, the terms "aluminum" and "titanium" are intended to encompass the metals and alloys and mixtures of metals and alloys formulated for the manufacture of bat shells.

2. Prior Art

U.S. Pat. No. 5,676,610 to Bhatt et al. discloses a tubular bat having a sheet of metal, wound into a spiral spring, in contact with the inner wall of the barrel of the bat. Shear stresses are not transferred from the outer shell to the metal insert leaving the bat compliant.

U.S. Pat. No. 5,533,723 issued Jul. 9, 1996 to Baum discloses a composite bat having a wood veneer surface and intermediate composite layer bonded to a tubular core of composite or aluminum. The core may comprise a resilient urethane foam and a cavity may be left in the core in the hitting area and the cavity may be filled with less dense material. The core may vary in density over the length of the bat, preferably with a higher density section near the barrel end.

U.S. Pat. No. 5,511,777 to McNeely discloses a bat having a rebounding core therein. A resilient attenuator sleeve is compressed between the outer shell and an inner damper fashioned from brass or a similar material. The resilient attenuator sleeve may be fashioned from a polystyrene closed cell foam.

U.S. Pat. No. 5,460,369 issued Oct. 24, 1995 to Baum discloses a composite bat having a wood veneer surface bonded to a composite tubular core.

U.S. Pat. No. 5,458,330 issued Oct. 17, 1995 to Baum discloses a composite bat having a wood veneer surface and cavitied foam core.

U.S. Pat. Nos. 5,511,777 and 5,415,398 issued to Eggiman disclose tubular bats having a rigid outer shell and a tubular insert in the ball striking area, the insert being spaced from the outer shell and acting independently thereof which is said to increase bat compliance while moderately limiting denting of the barrel. This design, due to the gap between the insert and the outer shell, fails to transfer shear stresses from the outer shell to the insert.

U.S. Pat. No. 5,395,108 Souders et al. issued Mar. 7, 1995 is an example of a fiber reinforced composite shell bat filled with expansible urethane foam to develop compressive stresses between the foam and the outer shell.

U.S. Pat. No. 5,364,095 issued Nov. 15, 1994 to Easton et al. discloses a tubular metal ball bat internally reinforced with a carbon fiber composite layer in firm compressive engagement with the outer shell.

U.S. Pat. No. 5,114,144 issued May 19, 1992 to Baum discloses a composite baseball bat made to look like a wood bat by using a central core of foamed plastic or extruded aluminum covered with a layer of resin impregnated fiber knitted or woven cloth and a surface layer of longitudinally extending planks or strips of resin coated wood veneer.

OBJECT OF THE INVENTION

The primary objective of the invention is to provide a more compliant lightweight yet strong and durable metal shell softball bat.

SUMMARY OF THE INVENTION

The present invention provides a ball bat comprising:

a) a rigid outer shell having a central axis and a handle and a barrel axially spaced from said handle;

b) a substantially cylindrical rigid insert in said barrel, said rigid insert being radially spaced from said outer shell; and c) an elastomeric layer having a COR of not less about than 40% and outer and inner generally cylindrical surfaces respectively engaged in force transmitting relationship with said outer shell and with said rigid insert.

DESCRIPTION OF THE PREFERRED EMBODIMENT

Figure 1:
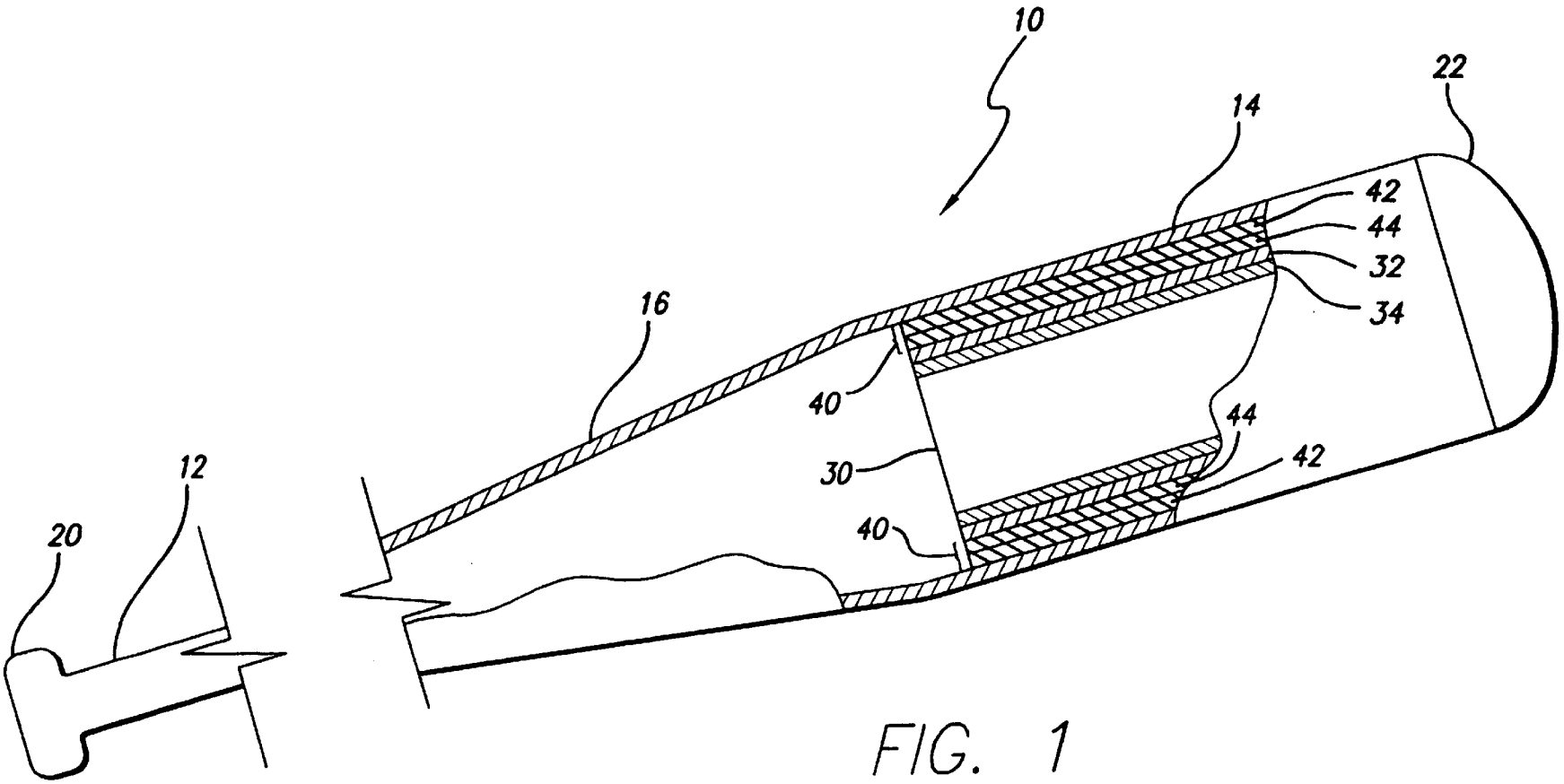
FIG. 1 is a perspective partially cut away view of a bat according to the present invention.

FIG. 1, shows a bat having a metal or metal alloy shell 10, preferably of aluminum, a handle 12, a barrel 14 and a tapered section 16 interconnecting the handle and the barrel. A knob 20 closes the handle end of the bat and a plug 22 is typically affixed to the barrel end of the bat as is well known. The ball hitting or striking area of the bat generally extends through the full length of the barrel section 14 partially into the tapered section 16 of the bat.

Reduction of the wall thickness of the outer shell 10 of a tubular bat desirably reduces the weight of the bat but increases the longitudinal flexibility thus absorbing a portion of the batter's energy which would otherwise be imparted to the ball and may result in permanent denting of the bat if the wall is too thin. Thinning of the wall of a metal shell bat also results in increased wall compliance, i.e., higher ball rebound velocity due to more significant flexing of the bat wall, commonly referred to as "trampoline effect." Composite shell bats and metal shell bats with resilient walls are intentionally designed to permit controlled localized flexing of the outer bat wall.

The bat of the present invention is designed for increased wall compliance and trampoline effect, strength and durability by use of a unique layered construction which is light weight yet strong and dent resistant. It is known that bats which are very flexible in longitudinal bending absorb energy and therefore reduce the effective leverage produced by the batter. At the same time, a bat having a high cross sectional rigidity such as a solid wood bat produces little, if any, trampoline effect and the resulting higher batted ball velocity which may be obtained with rigid shell bats. Pursuant to the invention which is primarily directed to softball bats which have a constant diameter barrel, the rigid outer shell 10 of the bat confines a substantially cylindrical rigid insert 30 in the barrel 14, the insert being radially spaced from the outer shell 10. A resilient elastomeric layer 40 having outer and inner generally cylindrical surfaces respectively engaged in force transmitting relationship with the outer shell 10 and with the rigid insert 30 is sandwiched between the outer shell and the insert so that the bat functions in the nature of a leaf spring. A single layer bat having the same thickness as the combined thicknesses of the individual layers is too rigid to deflect as intended. Layered bats develop friction between the layers which is lost energy. Unlike a lubricating layer which is used to minimize friction losses in a layered bat and transmits no shear stress between the outer shell 10 and insert 30, the elastomer layer in the present invention is capable of both transmitting shear stresses and temporarily storing and then releasing most of the energy otherwise lost to friction in a layered yet lubricated bat.

The outer shell 10 of the bat of the present invention comprises a tubular metallic member of aluminum or titanium or of composite construction such as carbon reinforced resin. It should be noted that the outer shell 10 need not be a single layer or be made of a single material. One or more layers of composite may be used with the reinforcing strands of carbon or other materials being oriented at different angles relative to the longitudinal axis of the bat, e.g., ±45° or some other orientation, as is known in the art. In the preferred embodiment which uses an outer shell and an insert each made of a high strength aluminum alloy, the thickness of the outer shell in the barrel or ball hitting area is significantly less than the thickness of the wall of the insert. Preferably, the thickness of the wall of the barrel 14 is in the range of from 55–85% of the radial thickness of the wall of the insert. Also, the outer shell wall thickness (in the range of from 0.036–0.055") is considerably thinner than the shell wall thickness of a typical prior art aluminum multi-wall softball bat (0.055" to 0.060").If a stronger but considerably more expensive metal such as titanium is used for the shell material, the wall thickness may be even thinner. The desired relationship between the outer shell and the insert when each is made of the same material may be expressed by the ratio of their moments of inertia $I=\frac{1}{12}wt^3$ where w is the width of a differential element and t is the total wall thickness of the shell or of the insert from which the element is taken. The ratio of the moment of inertia of the outer shell relative to the moment of inertia of the insert should be within the range of from 1.825 to 3.375.

The rigid insert 30 may be a single tube of aluminum or titanium or of composite or it may be comprised of two or more layers 32, 34 of a rigid material such as aluminum, titanium or steel foil or of one or more layers of a composite or of a combination of metallic and composite layers sized to fit into the barrel 14 of the bat. The insert 30 is preferably one generally cylindrical piece although the insert can be formed from separate arcuate pieces, e.g., two or three C-shaped sections, formed into a generally cylindrical configuration. In the preferred embodiment, a cylindrical aluminum tube having a wall thickness in the range of from 0.050–0.065" and having a length and width to fit into the barrel 14 of the outer shell 10 with a radial clearance in the range of about 0.050–0.060" is centrally positioned and longitudinally inserted into the barrel. If desired, prior to insertion of the insert 30 into the barrel 14, the insert may itself be internally further reinforced, e.g., by a fiber reinforced resin composite layer compressively restrained inside the aluminum tube of the insert as taught in U.S. Pat. No. 5,364,095 referred to above, the teachings of which are incorporated herein by reference. The rigid insert preferably has a length along the axis of the bat of about 2" less than the length of the barrel, e.g., for an 11" barrel, an insert of 9" is suitable.

The elastomeric layer 40 preferably has a radial thickness in the range of from 0.050–0.060" and may be a single elastomeric layer or be comprised of two or more preformed separate layers 42, 44 of elastomeric material or of elastomeric material and non-elastomeric material so long as the entire elastomeric layer taken as a whole has a relatively high coefficient of restitution (COR) not less than about 40%. The elastomeric layer 40 preferably comprises a compression molded sleeve which is then bonded to the outer surface of the rigid insert 30 with a suitable adhesive. The insert 30 and elastomeric layer 40 are then inserted as a unit into the barrel 14 and bonded thereto by additional adhesive. Alternatively, the elastomeric layer may be formed from a curable liquid which is poured into the annular space between the barrel 14 and insert 30 and cured in place at either ambient or elevated temperature.

Dynamic Denting Test

Two hundred 14" circumference softballs each weighing about 6.6 oz. were repeatedly fired horizontally by a cannon at a velocity of approximately 150 mph from a cannon positioned at a distance of about 2' radially into contact with the same spot on the barrel of a bat constructed according to the present invention and similarly against the barrels of various prior art bats.

The test bat constructed according to the present invention is a metal shell 10 of high strength aluminum alloy having a wall thickness at the barrel 14 of 0.040". The insert is a cylindrical aluminum tube having a wall thickness of 0.060" centrally positioned in the barrel 14 with a radial clearance of 0.057 between the shell and the insert. The clearance space was filled with a liquid elastomer having a COR of about 65% and allowed to cure at elevated temperature to form the elastomeric layer 40.

The prior art bats used for comparison purposes comprised:

a) An aluminum shell bat having an barrel wall thickness of 0.050" and an inner layer of titanium sheet 0.009" thick adhesively bonded to the interior wall of the barrel of the bat;

b) An aluminum shell bat having a barrel and a tubular insert, also of aluminum, each having substantially the same wall thickness of about 0.057", the insert positioned directly inside the barrel wall; and c) An aluminum shell bat having an outer barrel wall thickness of 0.056" reinforced by a composite inner core comprised of carbon fiber reinforced resin compressively restrained in the interior of the aluminum shell.

Figure 2:
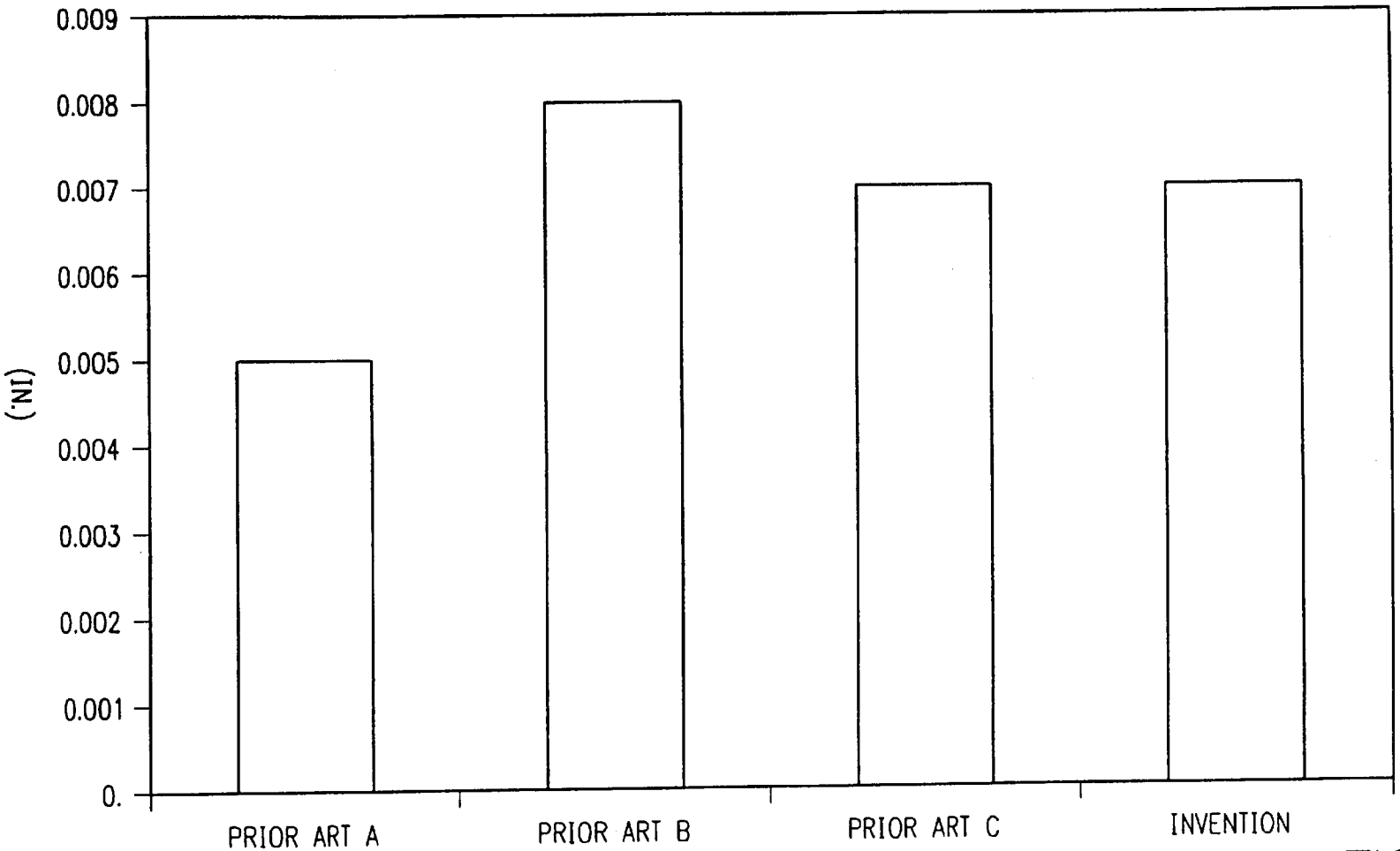
FIG. 2 is a graph comparing denting characteristics of the bat of the present invention with various prior art bats.

The test results are graphically illustrated in FIG. 2. The aluminum/titanium bat (a) experienced the least denting of about 0.005". The double aluminum wall bat (b) experienced the most significant permanent denting despite the relatively thicker barrel 14 with a depth of dent measured at approximately 0.008". The aluminum/composite reinforced bat (c) above and the elastomeric core bat of the present invention above each experienced permanent denting of about 0.007" but dent less than the double wall aluminum bat (b).

Static Barrel Cross Sectional Flexibility Test

Figure 3:
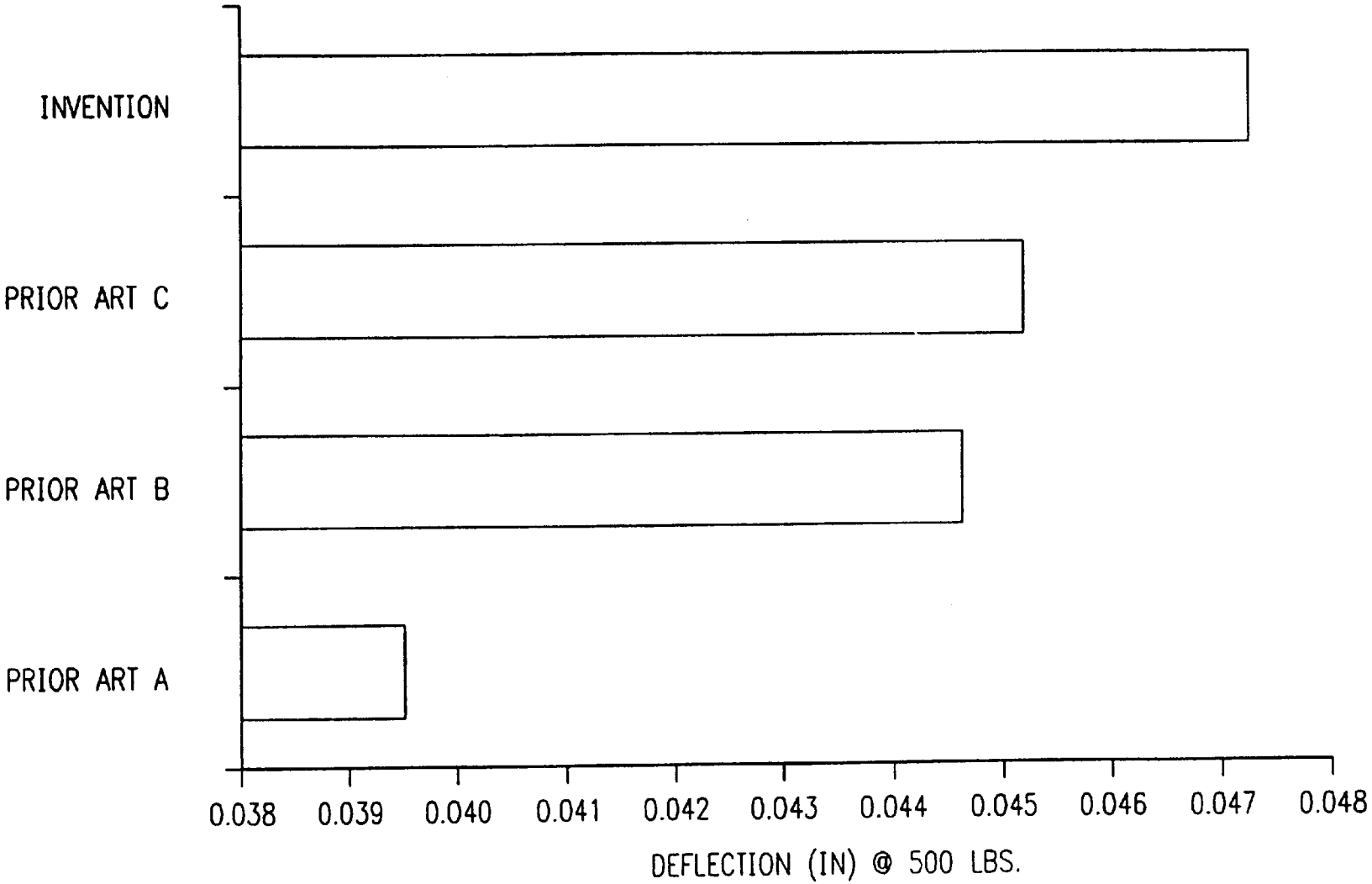
FIG. 3 is a graph comparing longitudinal barrel flexibility characteristics of the bat of the present invention with various prior art bats.

Cross-sectional rigidity tests of the same bats were also conducted to determine the amount of radial displacement of the barrel 14 under a transversely applied static load. These tests were made by horizontally supporting the barrel in on a flat support and applying a vertically directed load of 500 pounds downwardly through a one inch aluminum cylinder positioned transversely to the axis of the bat to compress the barrel 14 from above. The results are graphically illustrated in FIG. 3. Not shown is a wood bat which typically exhibits a displacement of 0.020". The prior art aluminum titanium core bat (a) shows the least trampoline effect represented by the relatively low deflection of only about 0.0395". The aluminum/aluminum double wall bat (b) and the aluminum/carbon fiber composite core bat (c) each exhibit a somewhat higher and similar displacement of about 0.045", the displacement of the carbon core bat being slightly greater. The elastomeric core bat of the present invention exhibits the most deflection measured at about 0.047" and thus provides the best trampoline effect of the bats tested exceeding that of the aluminum/carbon core bat (c) yet with acceptable denting as shown in FIG. 2.

Persons skilled in the art will appreciate that various modifications of the invention can be made from the above described preferred embodiment and that the scope of protection is limited only by the following claims.

What is claimed is:

1. A ball bat comprising:

an outer shell including a barrel, a handle, and a tapered section joining the handle to the barrel;

a substantially cylindrical insert radially spaced from an inner surface of the barrel; and a substantially cylindrical elastomeric layer located between and in force transmitting relationship with the outer shell and the insert, the elastomeric having a thickness of 0.050 to 0.060 inches and a coefficient of restitution of at least 40%.

2. The ball bat of claim 1 wherein the elastomeric layer is adhesively bonded to an outer surface of the insert and to the inner surface of the barrel.

3. The ball bat of claim 1 wherein the elastomeric layer comprises multiple layers.

4. The ball bat of claim 1 wherein the barrel has a thickness in the range of 0.036 to 0.055 inches.

5. The ball bat of claim 1 wherein the barrel has a thickness of 0.040 inches.

6. The ball bat of claim 1 wherein the insert has a thickness in the range of 0.050 to 0.065 inches.

7. The ball bat of claim 1 wherein the elastomeric layer has a coefficient of restitution of at least 65%.

8. A ball bat comprising:

an outer shell including a barrel, a handle, and a tapered section joining the handle to the barrel;

a substantially cylindrical insert radially spaced from an inner surface of the barrel; and a substantially cylindrical elastomeric layer located between and in force transmitting relationship with the outer shell and the insert, the elastomeric layer adhesively bonded to an outer surface of the insert and to the inner surface of the barrel, wherein the elastomeric layer has a thickness in the range of 0.050 to 0.060 inches, and the barrel has a thickness in the range of 70% to 100% of a thickness of the elastomeric layer.

9. The ball bat of claim 8 wherein the barrel has a thickness in the range of 0.036 to 0.055 inches.

10. The ball bat of claim 8 wherein the insert has a thickness in the range of 0.050 to 0.065 inches.

11. A ball bat comprising:

a metallic outer shell including a barrel, a handle, and a tapered section joining the handle to the barrel, the barrel having a thickness in the range of 0.036 to 0.055 inches;

a substantially cylindrical insert radially spaced from an inner surface of the barrel, wherein the thickness of the barrel is in the range of 55% to 85% of a thickness of the insert; and a substantially cylindrical elastomeric layer located between and in force transmitting relationship with the outer shell and the insert.

12. The ball bat of claim 11 wherein the elastomeric layer is adhesively bonded to an outer surface of the insert and to the inner surface of the barrel for optimally transmitting shear stresses from the outer shell to the insert, thereby substantially preventing denting of the outer shell upon contact with an object.

13. The ball bat of claim 11 wherein the outer shell comprises aluminum.

14. The ball bat of claim 11 wherein the insert comprises aluminum.

15. The ball bat of claim 11 wherein the insert has a thickness in the range of 0.050 to 0.065 inches.

16. The ball bat of claim 11 wherein the elastomeric layer has a thickness in the range of 0.050 to 0.060 inches.

17. The ball bat of claim 16 wherein the thickness of the barrel is in the range of 70% to 100% of the thickness of the elastomeric layer.

18. The ball bat of claim 11 wherein the outer shell has a moment of inertia 1.825 to 3.375 times greater than a moment of inertia of the insert.

19. The ball bat of claim 11 wherein the elastomeric layer has a coefficient of restitution of at least 40%.

20. The ball bat of claim 11 wherein the elastomeric layer has a coefficient of restitution of at least 65%.

* * * * *